US011430400B2

(12) United States Patent
Wu

(10) Patent No.: US 11,430,400 B2
(45) Date of Patent: Aug. 30, 2022

(54) DISPLAY PANEL, DRIVING METHOD AND DISPLAY DEVICE

(71) Applicant: HKC CORPORATION LIMITED, Shenzhen (CN)

(72) Inventor: Chuan Wu, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 670 days.

(21) Appl. No.: 16/329,221

(22) PCT Filed: Dec. 12, 2018

(86) PCT No.: PCT/CN2018/120474
§ 371 (c)(1),
(2) Date: Feb. 28, 2019

(87) PCT Pub. No.: WO2020/113631
PCT Pub. Date: Jun. 11, 2020

(65) Prior Publication Data

US 2021/0335306 A1 Oct. 28, 2021

(30) Foreign Application Priority Data

Dec. 5, 2018 (CN) ..... 201811480082.9

(51) Int. Cl.
*G09G 3/36* (2006.01)

(52) U.S. Cl.
CPC ..... *G09G 3/3677* (2013.01); *G09G 3/3614* (2013.01); *G09G 3/3688* (2013.01); *G09G 2310/08* (2013.01); *G09G 2320/0233* (2013.01)

(58) Field of Classification Search
CPC combination set(s) only.
See application file for complete search history.

(56) References Cited

U.S. PATENT DOCUMENTS 4,681,440 A * 7/1987 Burke ..... H01L 27/14875 250/214.1
2004/0119931 A1 6/2004 Baek et al.
(Continued)

FOREIGN PATENT DOCUMENTS

CN 101191924 A 6/2008
CN 101452676 A 6/2009
(Continued)

OTHER PUBLICATIONS

International Search Report issued in corresponding International application No. PCT/CN2018/120474, dated Aug. 27, 2019 (8 pages).
(Continued)

*Primary Examiner* — Van N Chow

(57) ABSTRACT

The present application discloses a display panel, a driving method and a display device. The display panel includes: a substrate, where the substrate is provided thereon with a plurality of data lines, a plurality of gate lines, and a plurality of pixels; each row of pixels includes a plurality of pixel groups, and each pixel group includes a first column of pixels and a second column of pixels; and a timing control chip configured to control the turn-on time of gate activating signals of the first column of pixels and the second column of pixels. The turn-on time of the gate activating signal of the first column of pixels is greater than the turn-on time of the gate activating signal of the corresponding second column of pixels.

12 Claims, 6 Drawing Sheets

(56) References Cited

U.S. PATENT DOCUMENTS

| | | | | |
|---|---|---|---|---|
| 2010/0097449 | A1* | 4/2010 | Jeong | H04N 13/359 348/59 |
| 2013/0093734 | A1* | 4/2013 | Wang | G09G 3/3648 345/204 |
| 2015/0145843 | A1 | 5/2015 | Park et al. | |
| 2015/0310815 | A1* | 10/2015 | Deng | G09G 3/3614 345/209 |
| 2021/0201729 | A1* | 7/2021 | Huang | G09G 3/3677 |

FOREIGN PATENT DOCUMENTS

| | | | |
|---|---|---|---|
| CN | 102332245 | A | 1/2012 |
| CN | 103985365 | A | 8/2014 |
| CN | 103996384 | A | 8/2014 |
| CN | 104317086 | A | 1/2015 |
| CN | 104361872 | A | 2/2015 |
| CN | 104391411 | A | 3/2015 |
| CN | 105096899 | A | 11/2015 |
| CN | 107154242 | A | 9/2017 |
| CN | 107507575 | A | 12/2017 |
| CN | 108847194 | A | 11/2018 |
| JP | 2007017928 | A | 1/2007 |

OTHER PUBLICATIONS

First Office Action from China patent office in a counterpart Chinese patent Application 201811480082.9, dated Dec. 20, 2019 (8 pages).
Second Office Action from China patent office in a counterpart Chinese patent Application 201811480082.9, dated Jul. 2, 2020 (9 pages).
Written Opinion of the International Searching Authority for No. PCT/CN2018/120474.

* cited by examiner

DISPLAY PANEL, DRIVING METHOD AND DISPLAY DEVICE

The present application claims priority to the Chinese Patent Application No. CN201811480082.9, filed with the Chinese Patent Office on Dec. 5, 2018, and entitled "DISPLAY PANEL, DRIVING METHOD AND DISPLAY DEVICE", which is incorporated herein by reference in its entirety.

TECHNICAL FIELD

The present application relates to the technical field of display, and in particular, to a display panel, a driving method and a display device.

BACKGROUND

The statements herein merely provide background information related to the present application and do not necessarily constitute the prior art.

With the development and advancement of technologies, liquid crystal displays have become mainstream products of displays due to their thin body, low power consumption and low radiation, and thus have been widely used. Most of the liquid crystal displays currently available on the market are backlight liquid crystal displays, which include a display panel and a backlight module. The working principle of the display panel is to place liquid crystal molecules in two parallel glass substrates, and apply driving voltages on the two glass substrates to control the rotation direction of the liquid crystal molecules to refract the light of the backlight module to generate a picture.

Half-Source Driver (HSD) technology is a low-cost production solution commonly used in the display panel industry. This solution doubles the number of scanning lines so that a single data line can correspond to sub-pixels of two adjacent columns, thereby saving half of the source driving integrated chips, but the case of vertical bright-dark lines would occur.

SUMMARY

An objective of the present application is to provide a display panel, a driving method and a display device for solving uneven brightness of the display panel.

To achieve the foregoing objective, the present application provides a display panel, including: a substrate, where the substrate is provided thereon with:

a plurality of data lines, a plurality of gate lines, and a plurality of pixels; and the pixels include sub-pixels of different colors respectively disposed along the direction of the gate lines; a gate driving chip configured to output a gate activating signal to the gate lines to turn on the pixels; each row of the pixels includes a plurality of pixel groups; each of the plurality of pixel groups includes an anterior first column of pixels and a posterior second column of pixels adjacent to each other; the first column of pixels and the second column of pixels are connected to the same data line; and the first column of pixels and the second column of pixels are connected to two different gate lines; the polarities of data driving signals adopted by each pixel group and an adjacent pixel group in each row of the pixels are opposite; a timing control chip configured to control the turn-on time of gate activating signals of the first column of pixels and the second column of pixels; the turn-on time of the gate activating signal of the first column of pixels is greater than the turn-on time of the gate activating signal of the corresponding second column of pixels.

Optionally, the polarities of data driving voltages corresponding to the first column of pixels and the second column of pixels are opposite, the first column of pixels is an odd-numbered column of pixels, and the second column of pixels is an even-numbered column of pixels; the turn-on time C1 of a gate activating signal of the corresponding odd-numbered column of pixels is greater than the turn-on time C2 of a gate activating signal of the even-numbered column of pixels.

Optionally, $C1>C2$, and $C2=m*C1$, where m is at least equal to 0.5 and less than 1.

Optionally, $C1>C2$, and $C2=m*C1$, where m is greater than 0.3 and less than 0.5.

Optionally, the charging amount of the first column of pixels is equal to that of the second column of pixels.

Optionally, the charging amount of the first column of pixels is equal to that of the second column of pixels within a preset threshold range.

Optionally, the value of m is one of 0.5, 0.6, 0.7, 0.8, and 0.9.

Optionally, the value of m is one of 0.55, 0.65, 0.75, 0.85, and 0.95.

Optionally, in different pixel groups, the m values satisfied between the odd-numbered column of pixels and the even-numbered column of pixels are the same.

Optionally, in different pixel groups, the m values satisfied between the odd-numbered column of pixels and the even-numbered column of pixels are different.

Optionally, the polarities of data driving voltages corresponding to the first column of pixels and the second column of pixels are the same, the first column of pixels is an even-numbered column of pixels, and the second column of pixels is an odd-numbered column of pixels; the turn-on time C2 of a gate activating signal of the corresponding even-numbered column of pixels is greater than the turn-on time C1 of a gate activating signal of the odd-numbered column of pixels.

Optionally, $C2>C1$, and $m*C2=C1$, where m is at least equal to 0.5 and less than 1.

The present application further discloses a driving method of a display panel, including the following steps:

outputting, by a gate driving chip, a gate activating signal to each row of pixels according to a preset number of times;

outputting, by a data driving chip, a same data signal to a first column of pixels and a second column of pixels of each row of pixels;

controlling each pixel group and an adjacent pixel group in each row of pixels to adopt data driving signals of opposite polarities; and controlling, by the gate driving chip, the turn-on time of a gate activating signal of the corresponding second column of pixels to be less than the turn-on time of a gate activating signal of the corresponding first column of pixels.

Optionally, the polarities of data driving voltages corresponding to the first column of pixels and the second column of pixels are opposite, the first column of pixels is an odd-numbered column of pixels, and the second column of pixels is an even-numbered column of pixels; the turn-on time C1 of a gate activating signal of the corresponding odd-numbered column of pixels is greater than the turn-on time C2 of a gate activating signal of the even-numbered column of pixels.

Optionally, $C1>C2$, and $C2=m*C1$, where m is at least equal to 0.5 and less than 1.

The present application further discloses a display device, including the display panel as mentioned above.

Due to the positive and negative polarity conversion of the data line, the data driving voltage corresponding to the second column of pixels of the current group requires a period of time to be reversed to a preset voltage level, and the charging amount of the second column of pixels is greater than the charging amount of the first column of pixels in the same charging time, and as a result, the final charging voltage of the first column of pixels is less than the charging voltage of the second column of pixels, and thus the case of vertical bright-dark lines may occur. In this solution, the timing control chip controls the turn-on time of the gate activating signal of the corresponding first column of pixels to be greater than the turn-on time of the gate activating signal of the corresponding second column of pixels, and at this time, the turn-on time of the gate activating signal of the first column of pixels is prolonged so that the charging amount of the first column of pixels is relatively increased, and the finally charging voltage corresponding to the first column of pixels is increased, thereby reducing a voltage difference to the second column of pixels, even making the charging voltages of two adjacent pixels after the last charging be the same, so as to eliminate the visual vertical bright-dark lines.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
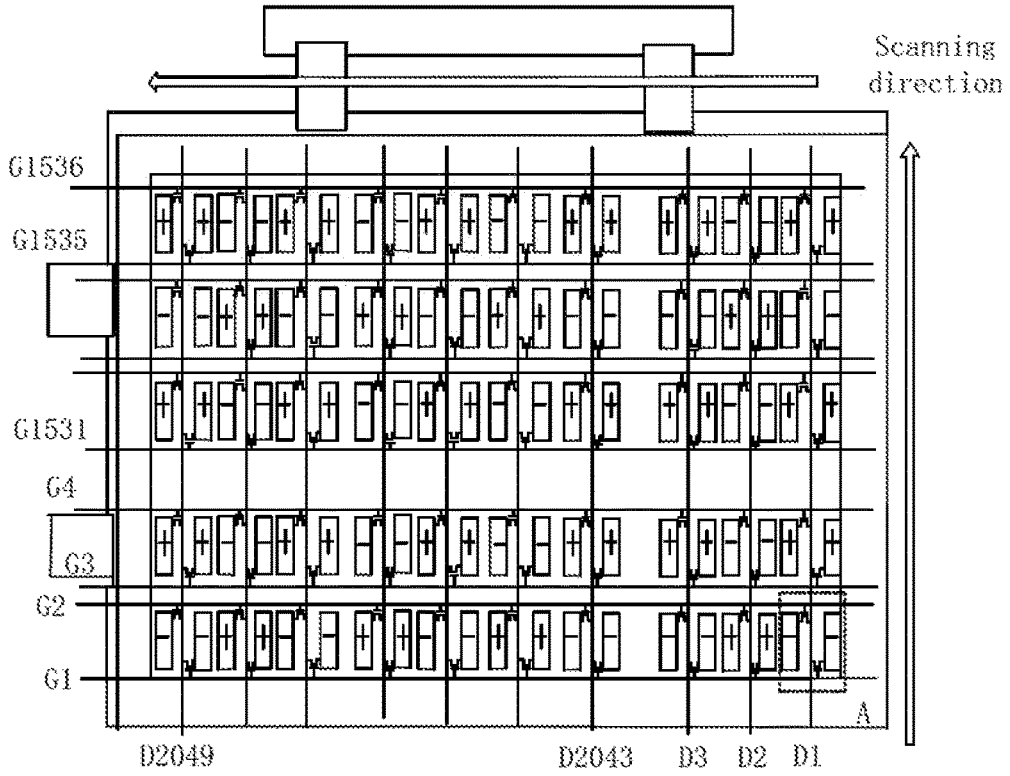
FIG. 1 is a schematic diagram of an HSD architecture according to an embodiment of the present application.

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right". "vertical", "horizontal", "top". "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms such as "first" and "second" are merely for a descriptive purpose, and cannot be understood as indicating or implying relative importance, or implicitly indicating the number of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood by a person of ordinary skill in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

The present application is further described below with reference to the accompanying drawings and optional embodiments.

Figure 2:
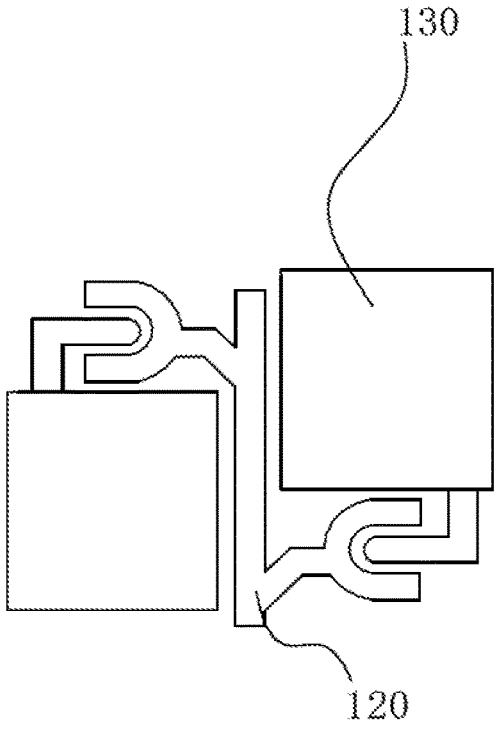
FIG. 2 is a partially enlarged schematic diagram of a region A of FIG. 1.
Figure 3:
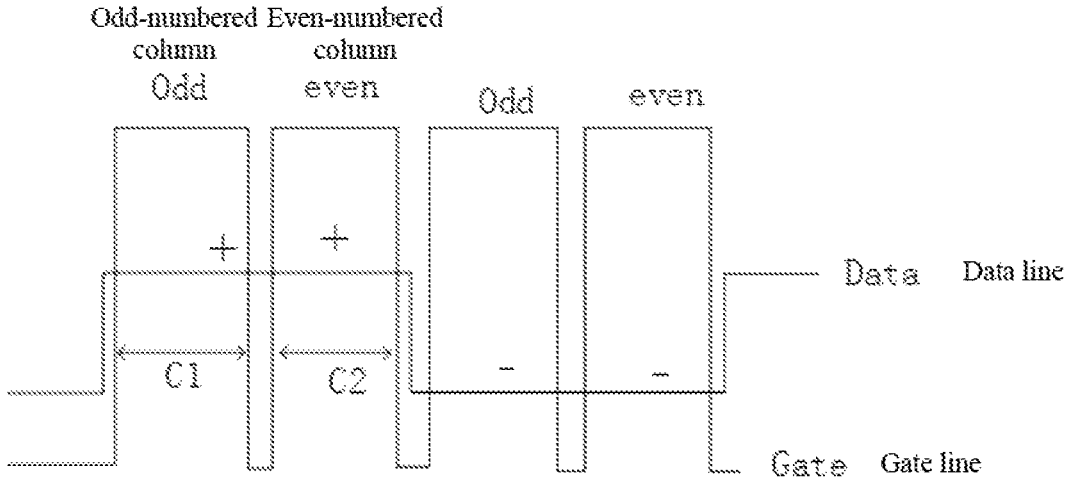
FIG. 3 is a schematic diagram of a data output waveform of the HSD architecture according to an embodiment of the present application.
Figure 4:
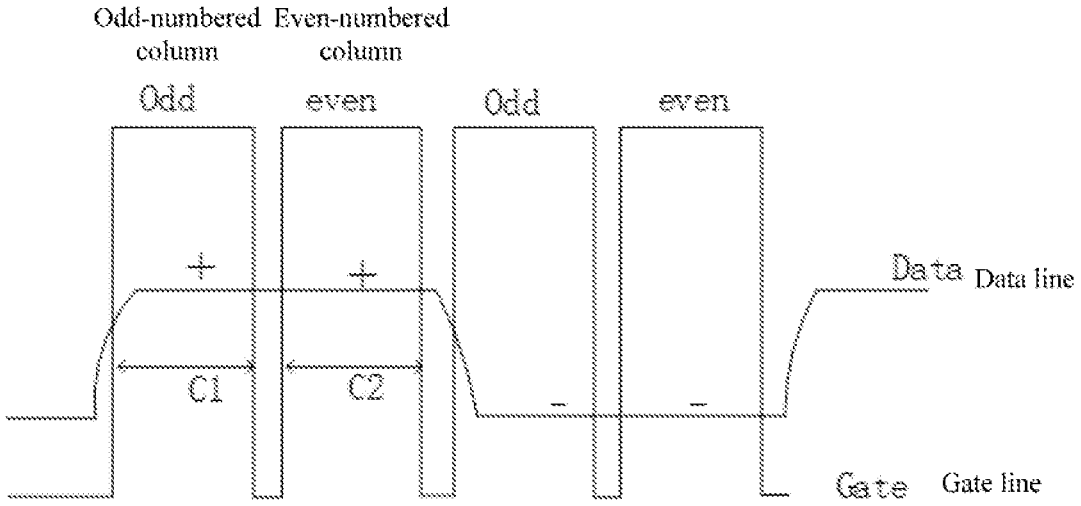
FIG. 4 is a schematic diagram of an actual data output waveform of the HSD architecture according to an embodiment of the present application.
Figure 5:
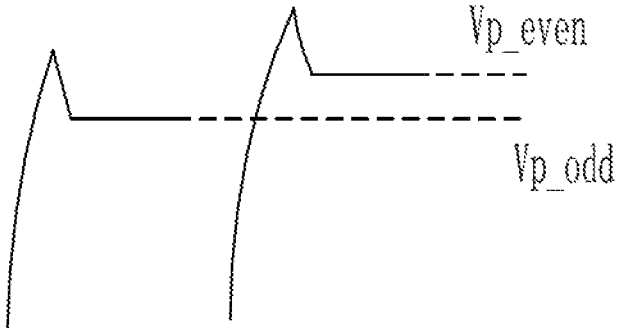
FIG. 5 is a schematic diagram of a pixel voltage of the HSD architecture according to an embodiment of the present application.
Figure 6:
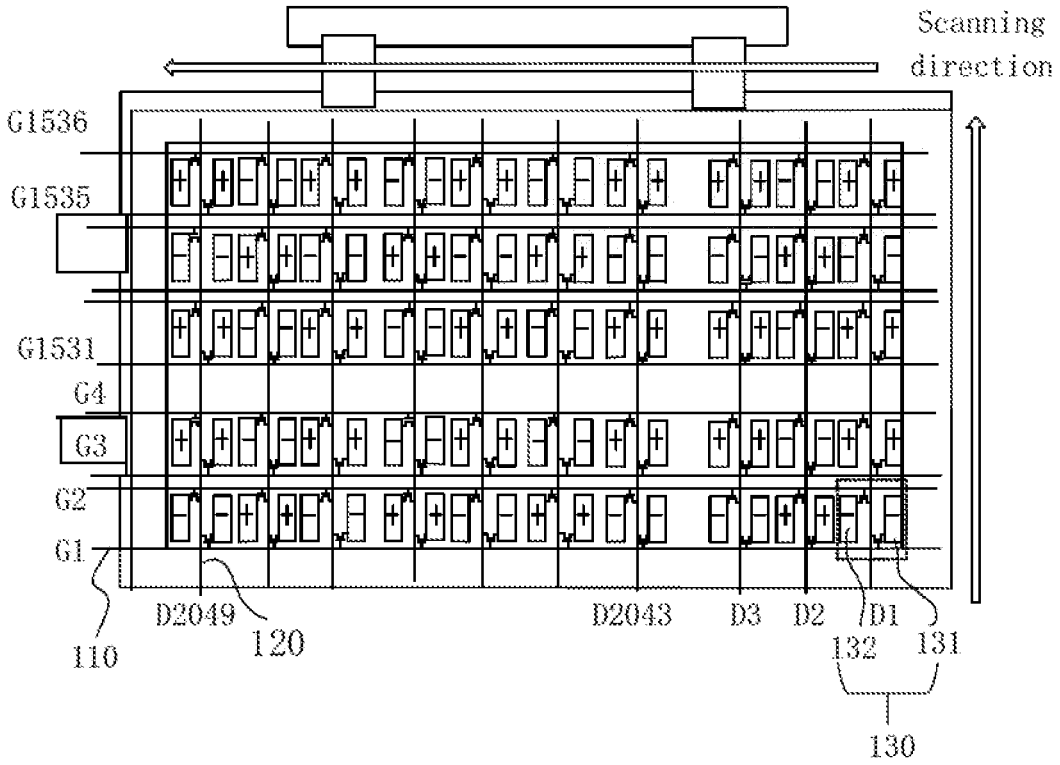
FIG. 6 is a schematic diagram of a display panel according to an embodiment of the present application.

As shown in FIGS. 1 and 2, two adjacent columns of pixels share a data line 120, and adjacent pixels are connected to different gate lines 110. When a gate activating signal is turned on, a corresponding row of thin film transistors is turned on. At this time, the data lines 120 in the vertical direction transmit corresponding data signals to charge a storage capacitor to an appropriate voltage, so that a row of images can be displayed. As shown in FIGS. 3 and 4, Data represents a waveform of the data line 120, and Gate represents a waveform of the gate line 110; when Gate is high, it is turned on, and the corresponding odd-numbered column of pixels Odd and even-numbered column of pixels even are turned on. Since the data line 120 has the positive and negative polarity conversion, during the positive and negative polarity conversion of the data line 120, the data driving voltage of the corresponding odd-numbered column of pixels subjected to polarity reversal requires a period of time to reach a preset voltage strength, causing that the current odd-numbered column of pixels and an even-numbered column of pixels adjacent thereto and sharing a data line 120 therewith have the same turn-on time under the activation of the same gate activating signal, C1 is the turn-on time of the first row of gate activating signals, C2 is the turn-on time of the second row of gate activating signals, and C1=C2, and moreover, there is a difference between the final charging states of two pixels. As shown in FIG. 5, a voltage of the even-numbered column of pixels is greater than a voltage of the odd-numbered column of pixels, Vp_even is a pixel voltage corresponding to the even-numbered column, and Vp_odd is a pixel voltage corresponding to the odd-numbered column, and thus the brightness of the even-numbered column of pixels is brighter than the brightness of the odd-numbered column of pixels, and the case of vertical bright-dark lines would occur.

As shown in FIGS. 6-9, an embodiment of the present application discloses a display panel, including a substrate, where the substrate is provided thereon with: a plurality of data lines 120, a plurality of gate lines 110, and a plurality of pixels 130; and the pixels 130 include sub-pixels of different colors respectively disposed along the direction of the gate lines 110; a gate driving chip 102 configured to output a gate activating signal to the gate lines 110 to turn on the pixels; each row of the pixels includes a plurality of pixel groups; each of the plurality of pixel groups includes an anterior first column of pixels 131 and a posterior second column of pixels 132 adjacent to each other; the first column of pixels 131 and the second column of pixels 132 are connected to the same data line 120; and the first column of pixels 131 and the second column of pixels 132 are connected to two different gate lines 110; the polarities of data driving signals adopted by each pixel group and an adjacent pixel group in each row of the pixels are opposite; a timing control chip configured to control the turn-on time of gate activating signals of the first column of pixels 131 and the second column of pixels 132; the turn-on time of the gate activating signal of the first column of pixels 131 is greater than the turn-on time of the gate activating signal of the corresponding second column of pixels 132.

Due to the positive and negative polarity conversion of the data line 120, the data driving voltage corresponding to the second column of pixels 132 of the current group requires a period of time to be reversed to a preset voltage level, and the charging amount of the second column of pixels 132 is greater than the charging amount of the first column of pixels in the same charging time, and as a result, the final charging voltage of the first column of pixels 131 is less than the charging voltage of the second column of pixels 132, and thus the case of vertical bright-dark lines may occur. In this solution, the timing control chip controls the turn-on time of the gate activating signal of the corresponding first column of pixels 131 to be greater than the turn-on time of the gate activating signal of the corresponding second column of pixels 132, and at this time, the turn-on time of the gate activating signal of the first column of pixels 131 is prolonged so that the charging amount of the first column of pixels 131 is relatively increased, and the finally charging voltage corresponding to the first column of pixels 131 is increased, thereby reducing a voltage difference to the second column of pixels 132, even making the charging voltages of two adjacent pixels after the last charging be the same, so as to eliminate the visual vertical bright-dark lines.

In one or more embodiments, the polarities of data driving voltages corresponding to the first column of pixels 131 and the second column of pixels 132 are opposite, the first column of pixels 131 is an odd-numbered column of pixels, and the second column of pixels 132 is an even-numbered column of pixels; the turn-on time C1 of a gate activating signal of the corresponding odd-numbered column of pixels is greater than the turn-on time C2 of a gate activating signal of the even-numbered column of pixels.

In this solution, the first column of pixels 131 is an odd-numbered column of pixels, and the second column of pixels 132 is an even-numbered column of pixels; the turn-on time C1 of a gate activating signal of the corresponding odd-numbered column of pixels is greater than the turn-on time C2 of a gate activating signal of the even-numbered column of pixels; the turn-on time of the gate activating signal of the odd-numbered column of pixels is prolonged so that the charging amount of the odd-numbered column of pixels is increased, thereby reducing the voltage difference to the even-numbered column of pixels, and finally making the charging voltages of two adjacent pixels after the last charging be the same, so as to eliminate the visual vertical bright-dark lines. Moreover, there is no need to change the circuit architecture, it only needs to adjust the turn-on time of the gate activating signal, which is advantageous for improving the yield and avoiding an increase in production cost.

Figure 7:
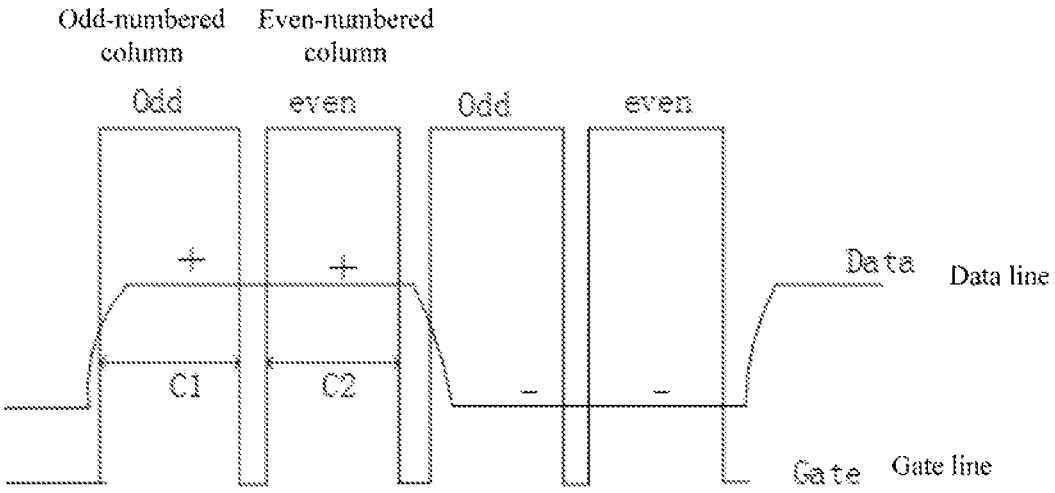
FIG. 7 is a schematic diagram (1) of a driving timing signal of a display panel according to an embodiment of the present application.
Figure 8:
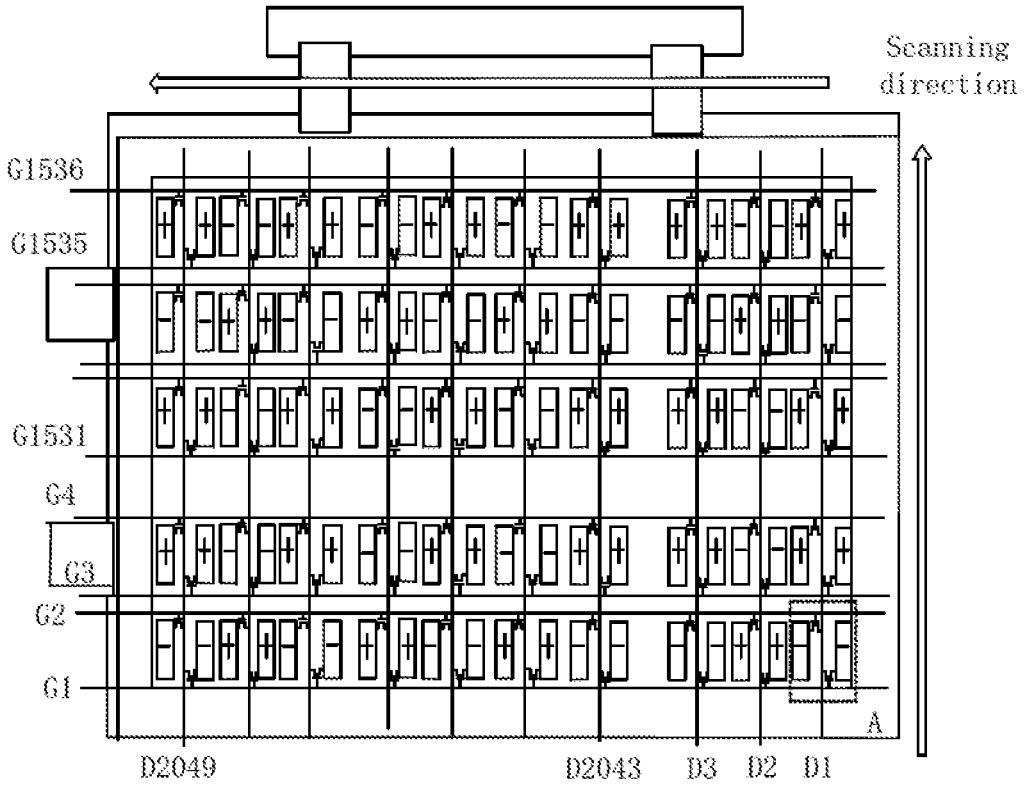
FIG. 8 is a schematic diagram of another HSD architecture of a display panel according to an embodiment of the present application.
Figure 9:
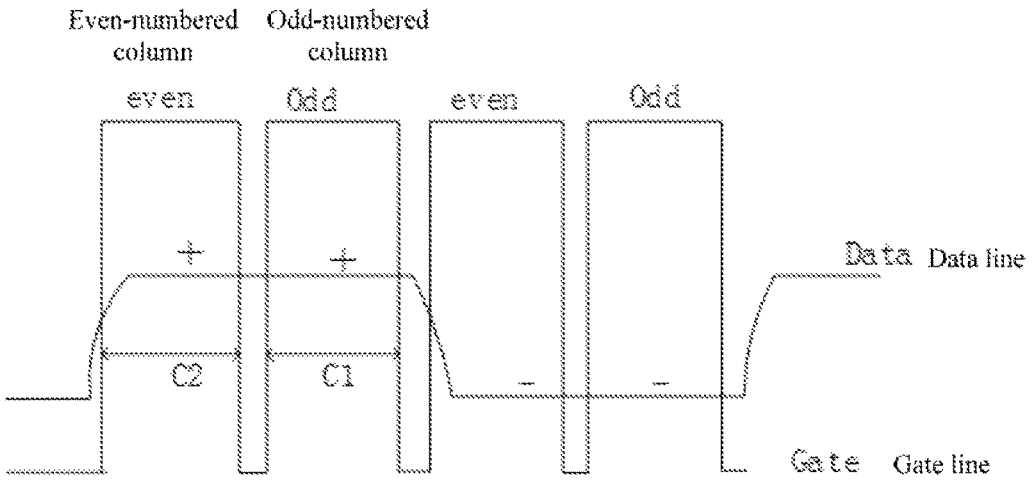
FIG. 9 is a schematic diagram (2) of a driving timing signal of a display panel according to an embodiment of the present application.

As shown in FIG. 7, In one or more embodiments, C1>C2, and C2=m*C1, where m is at least equal to 0.5 and less than 1.

In this solution, m is at least equal to 0.5 and less than 1, so that the charging voltages of two adjacent pixels after the last charging are the same, thereby solving the case of visual vertical bight-dark lines; if the value of m is less than 0.5, the charging time of the first column of pixels 131 is too long, which may cause the frame scanning time too long, to result in poor display effect; if the value of m is greater than 1, the charging time is too short, as a result, the effect of increasing the final charging voltage of C1 cannot be achieved, and the effect of eliminating the bright-dark lines is unsatisfactory.

In one or more embodiments, C1>C2, and C2=m*C1, where in is greater than 0.3 and less than 0.5.

Due to the polarity conversion of the data voltage in a same data line, the voltage value of the data line requires a period of time to reach a predetermined voltage, and thus there is a difference between the brightness of the odd-numbered column of pixels and the even-numbered column of pixels. In this solution, C1 is greater than C2, and C2=m*C1, i.e., the turn-on time of the gate activating signal of the odd-numbered column of pixels is greater than the turn-on time of the gate activating signal of the even-numbered column of pixels, and the value of m is greater than 0.3 and less than 0.5, so as to reduce the difference between the brightness of the odd-numbered column of pixels and the even-numbered column of pixels, thereby decreasing the visual discomfort caused by the brightness of different columns of pixels.

Due to the value of m, the charging amount of the first column of pixels 131 is equal to that of the second column of pixels 132, and when a difference between the charging amounts thereof is within a preset threshold range, the first column of pixels 131 and the second column of pixels 132 can be considered as the same. The value of m can be: m=0.5, 0.55, 0.6, 0.65, 0.7, 0.75, 0.8, 0.85, 0.9, 0.95, etc., which is not limited thereto.

In one or more embodiments, in different pixel groups, the m values satisfied between the odd-numbered column of pixels and the even-numbered column of pixels are the same. The value of m can be set to satisfy the reduction of the brightness difference between the odd-numbered column of pixels and the even-numbered column of pixels, and the setting of the m values is the same when a preset m value is preset, and the setting is convenient.

In one or more embodiments, in different pixel groups, the m values satisfied between the odd-numbered column of pixels and the even-numbered column of pixels are different. In this solution, in different pixel groups, the m values satisfied between the odd-numbered column of pixels and the even-numbered column of pixels are different. For large-sized products, due to the existence of RC delay, the brightness of the entry end of the two gate activating signals is higher, and the charging effect becomes worse after passing the RC delay. Therefore, the in values satisfied between the odd-numbered column of pixels and the even-numbered column of pixels are set to be different, and when a brightness difference exists, the difference can be adjusted by the m values, so that the overall display effect is superior.

In one or more embodiments, the polarities of data driving voltages corresponding to the first column of pixels 131 and the second column of pixels 132 are the same, the first column of pixels 131 is an even-numbered column of pixels, and the second column of pixels 132 is an odd-numbered column of pixels; the turn-on time C2 of a gate activating signal of the corresponding even-numbered column of pixels is greater than the turn-on time C1 of a gate activating signal of the odd-numbered column of pixels.

In this solution, the first column of pixels 131 is an even-numbered column of pixels, and the second column of pixels 132 is an odd-numbered column of pixels; the turn-on time C2 of a gate activating signal of the corresponding even-numbered column of pixels is greater than the turn-on time C1 of a gate activating signal of the odd-numbered column of pixels; the turn-on time of the gate activating signal of the even-numbered column of pixels is prolonged so that the charging amount of the even-numbered column of pixels is increased, thereby reducing the voltage difference to the odd-numbered column of pixels, and finally making the charging voltages of two adjacent pixels after the last charging be the same, so as to eliminate the visual vertical bright-dark lines. Moreover, there is no need to change the circuit architecture, it only needs to adjust the turn-on time of the gate activating signal, which is advantageous for improving the yield and avoiding an increase in production cost.

In one or more embodiments, C2>C1, and m*C2=C1, where m is at least equal to 0.5 and less than 1.

Due to the value of m, the charging amount of the first column of pixels 131 is equal to that of the second column of pixels 132, and when a difference between the charging amounts thereof is within a preset threshold range, the first column of pixels 131 and the second column of pixels 132 can be considered as the same. The value of m can be: m=0.5, 0.55, 0.6, 0.65, 0.7, 0.75, 0.8, 0.85, 0.9, 0.95, etc., which is not limited thereto.

In this solution, m is at least equal to 0.5 and less than 1, so that the charging voltages of two adjacent pixels after the last charging are the same, thereby solving the case of visual vertical bright-dark lines; if the value of m is less than 0.5, the charging time of the first column of pixels 131 is too long, which may cause the frame scanning time too long, to result in poor display effect: if the value of m is greater than 1, the charging time is too short, as a result, the effect of increasing the final charging voltage of C1 cannot be achieved, and the effect of eliminating the bright-dark lines is unsatisfactory.

In one or more embodiments of the present application, as shown in FIGS. 6-9, disclosed is a display panel 101, including:

a substrate, where the substrate is provided thereon with a plurality of data lines 120, a plurality of gate lines 110, and a plurality of pixels; and the pixels include sub-pixels of different colors respectively disposed along the direction of the gate lines 110; a gate driving chip 102 configured to output a gate activating signal to the gate lines 110 to turn on the pixels; each row of the pixels includes a plurality of pixel groups; each of the plurality of pixel groups includes a first column of pixels 131 and a second column of pixels 132 adjacent to each other; the first column of pixels 131 and the second column of pixels 132 are connected to the same data line 120; and the first column of pixels 131 and the second column of pixels 132 are connected to two different gate lines 110; the polarities of data driving signals adopted by each pixel group and an adjacent pixel group in each row of the pixels are opposite; the polarities of data driving voltages corresponding to the first column of pixels 131 and the second column of pixels 132 are opposite, the first column of pixels 131 is an odd-numbered column of pixels, and the second column of pixels 132 is an even-numbered column of pixels; the turn-on time C1 of a gate activating signal of the corresponding odd-numbered column of pixels is greater than the turn-on time C2 of a gate activating signal of the even-numbered column of pixels; C1>C2, and C2=m*C1, where m is at least equal to 0.5 and less than 1.

Due to the positive and negative polarity conversion of the data line 120, the data driving voltage corresponding to the second column of pixels 132 of the current group requires a period of time to be reversed to a preset voltage level, and the charging amount of the second column of pixels 132 is greater than the charging amount of the first column of pixels in the same charging time, and as a result, the final charging voltage of the first column of pixels 131 is less than the charging voltage of the second column of pixels 132, and thus the case of vertical bright-dark lines may occur. In this solution, the timing control chip controls the turn-on time of the gate activating signal of the corresponding first column of pixels 131 to be greater than the turn-on time of the gate activating signal of the corresponding second column of pixels 132, and at this time, the turn-on time of the gate activating signal of the first column of pixels 131 is prolonged so that the charging amount of the first column of pixels 131 is relatively increased, and the finally charging voltage corresponding to the first column of pixels 131 is increased, thereby reducing a voltage difference to the second column of pixels 132, even making the charging voltages of two adjacent pixels after the last charging be the same, so as to eliminate the visual vertical bright-dark lines.

Figure 10:
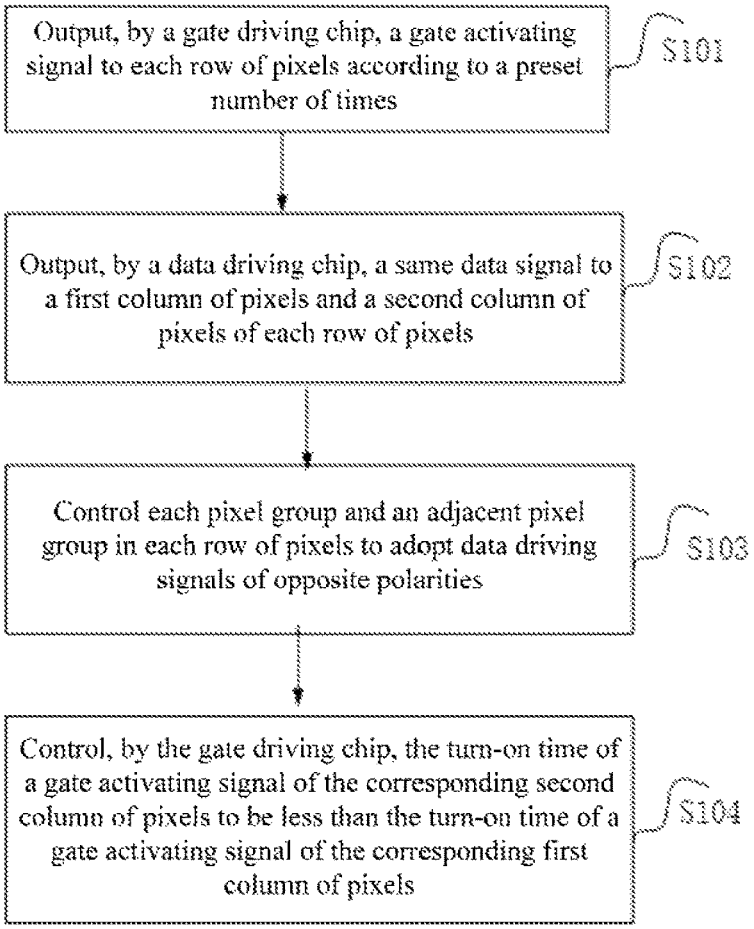
FIG. 10 is a schematic flowchart of a driving method of a display panel according to an embodiment of the present application.

As another embodiment of the present application, as shown in FIG. 10, disclosed is a driving method of a display panel 101, including the following steps:

S101: Outputting, by a gate driving chip 102, a gate activating signal to each row of pixels according to a preset number of times;

S102: Outputting, by a data driving chip 103, a same data signal to a first column of pixels 131 and a second column of pixels 132 of each row of pixels;

S103: Controlling each pixel group and an adjacent pixel group in each row of pixels to adopt data driving signals of opposite polarities;

S104: Controlling, by the gate driving chip 102, the turn-on time of a gate activating signal of the corresponding second column of pixels 132 to be less than the turn-on time of a gate activating signal of the corresponding first column of pixels 131.

Due to the positive and negative polarity conversion of the data line 120, the data driving voltage corresponding to the second column of pixels 132 of the current group requires a period of time to be reversed to a preset voltage level, and the charging amount of the second column of pixels 132 is greater than the charging amount of the first column of pixels in the same charging time, and as a result, the final charging voltage of the first column of pixels 131 is less than the charging voltage of the second column of pixels 132, and thus the case of vertical bright-dark lines may occur. In this solution, the timing control chip controls the turn-on time of the gate activating signal of the corresponding first column of pixels 131 to be greater than the turn-on time of the gate activating signal of the corresponding second column of pixels 132, and at this time, the turn-on time of the gate activating signal of the first column of pixels 131 is prolonged so that the charging amount of the first column of pixels 131 is relatively increased, and the finally charging voltage corresponding to the first column of pixels 131 is increased, thereby reducing a voltage difference to the second column of pixels 132, even making the charging voltages of two adjacent pixels after the last charging be the same, so as to eliminate the visual vertical bright-dark lines.

It should be noted that the definitions of steps involved in this solution are not intended to limit the sequence of steps without affecting the implementation of the specific solution. The preceding steps can be executed anteriorly, and can also be executed posteriorly, or even can be executed simultaneously. As long as this solution can be implemented, it should be considered as the scope of protection of the present application.

In one or more embodiments, the polarities of data driving voltages corresponding to the first column of pixels 131 and the second column of pixels 132 are opposite, the first column of pixels 131 is an odd-numbered column of pixels, and the second column of pixels 132 is an even-numbered column of pixels; the turn-on time C1 of a gate activating signal of the corresponding odd-numbered column of pixels is greater than the turn-on time C2 of a gate activating signal of the even-numbered column of pixels.

In this solution, the first column of pixels 131 is an odd-numbered column of pixels, and the second column of pixels 132 is an even-numbered column of pixels: the turn-on time C1 of a gate activating signal of the corresponding odd-numbered column of pixels is greater than the turn-on time C2 of a gate activating signal of the even-numbered column of pixels; the turn-on time of the gate activating signal of the odd-numbered column of pixels is prolonged so that the charging amount of the odd-numbered column of pixels is increased, thereby reducing the voltage difference to the even-numbered column of pixels, and finally making the charging voltages of two adjacent pixels after the last charging be the same, so as to eliminate the visual vertical bright-dark lines. Moreover, there is no need to change the circuit architecture, it only needs to adjust the turn-on time of the gate activating signal, which is advantageous for improving the yield and avoiding an increase in production cost.

In one or more embodiments, C1>C2, and C2=m*C1, where m is at least equal to 0.5 and less than 1. Due to the value of m, the charging amount of the first column of pixels 131 is equal to that of the second column of pixels 132, and when a difference between the charging amounts thereof is within a preset threshold range, the first column of pixels 131 and the second column of pixels 132 can be considered as the same. The value of m can be: m=0.5, 0.55, 0.6, 0.65, 0.7, 0.75, 0.8, 0.85, 0.9, 0.95, etc., which is not limited thereto.

In this solution, m is at least equal to 0.5 and less than 1, so that the charging voltages of two adjacent pixels after the last charging are the same, thereby solving the case of visual vertical bright-dark lines; if the value of m is less than 0.5, the charging time of the first column of pixels 131 is too long, which may cause the frame scanning time too long, to result in poor display effect; if the value of m is greater than 1, the charging time is too short, as a result, the effect of increasing the final charging voltage of C1 cannot be achieved, and the effect of eliminating the bright-dark lines is unsatisfactory.

Figure 11:
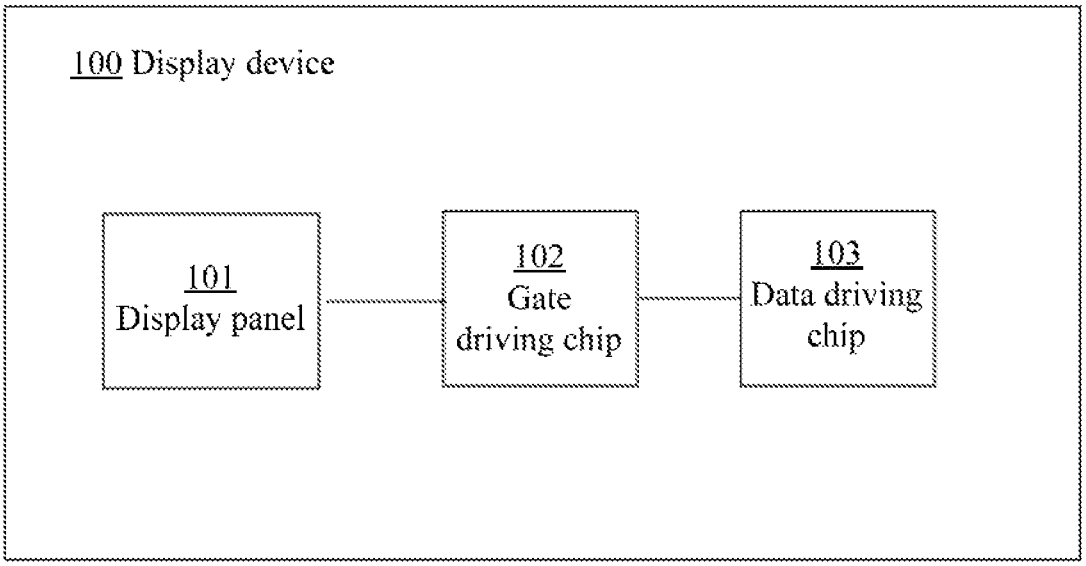
FIG. 11 is a schematic block diagram of a display device according to an embodiment of the present application.

As another embodiment of the present application, as shown in FIG. 11, disclosed is a display device 100, including the display panel 101 as mentioned above.

Due to the positive and negative polarity conversion of the data line 120, the data driving voltage corresponding to the second column of pixels 132 of the current group requires a period of time to be reversed to a preset voltage level, and the charging amount of the second column of pixels 132 is greater than the charging amount of the first column of pixels in the same charging time, and as a result, the final charging voltage of the first column of pixels 131 is less than the charging voltage of the second column of pixels 132, and thus the case of vertical bright-dark lines may occur. In this solution, the timing control chip controls the turn-on time of the gate activating signal of the corresponding first column of pixels 131 to be greater than the turn-on time of the gate activating signal of the corresponding second column of pixels 132, and at this time, the turn-on time of the gate activating signal of the first column of pixels 131 is prolonged so that the charging amount of the first column of pixels 131 is relatively increased, and the finally charging voltage corresponding to the first column of pixels 131 is increased, thereby reducing a voltage difference to the second column of pixels 132, even making the charging voltages of two adjacent pixels after the last charging be the same, so as to eliminate the visual vertical bright-dark lines.

The panel in the present application may be a Twisted Nematic (TN) panel, an In-Plane Switching (IPS) panel, and a Multi-domain Vertical Alignment (VA) panel, and of course, may also be other types of panels, if appropriate.

The contents above are further detailed descriptions of the present application in conjunction with optional specific embodiments, and the specific implementation of the present application is not limited to these descriptions. It will be apparent to those skilled in the art that various simple deductions or substitutions may be made without departing from the spirit of the present application, and should be considered to be within the scope of protection of the present application.

What is claimed is:

1. A display panel, comprising:

a substrate;

the substrate is provided thereon with:

a plurality of data lines, a plurality of gate lines, and a plurality of pixels;

the pixels comprise sub-pixels of different colors respectively disposed along the direction of the gate lines; and a gate driving chip configured to output a gate activating signal to the gate lines to turn on the pixels;

each row of the pixels comprises a plurality of pixel groups; each of the plurality of pixel groups comprises an anterior first-column pixel and a posterior second-column pixel adjacent to each other; the first-column pixel and the second-column pixel are connected to the same data line; and the first-column pixel and the second-column pixel are connected to two different gate lines;

the polarities of data driving signals adopted by each pixel group and an adjacent pixel group in each row of the pixels are opposite;

a timing control chip configured to control the turn-on time of gate activating signals of the first-column pixel and the second-column pixel;

the turn-on time of the gate activating signal of the first-column pixel is greater than the turn-on time of the gate activating signal of the corresponding second-column pixel;

wherein the polarities of data driving voltages corresponding to the first-column pixel and the second-column pixel are the same the first-column pixel is an odd-numbered column of pixel, and the second-column pixel is an even-numbered column of pixel;

the turn-on time C1 of a gate activating signal of the corresponding odd-numbered column of pixel is greater than the turn-on time C2 of a gate activating signal of the even-numbered column of pixel;

wherein C1>C2, and C2=m*C1, wherein in is greater than 0.3 and less than 0.5.

2. The display panel according to claim 1, wherein the charging amount of the first-column pixel is equal to that of the second-column pixel.

3. The display panel according to claim 1, wherein the charging amount of the first-column pixel is equal to that of the second-column pixel within a preset threshold range.

4. The display panel according to claim 1, wherein in different pixel groups, the m values satisfied between the odd-numbered column of pixels and the even-numbered column of pixels are the same.

5. The display panel according to claim 1, wherein in different pixel groups, the m values satisfied between the odd-numbered column of pixels and the even-numbered column of pixels are different.

6. The display panel according to claim 1, wherein the polarities of data driving voltages corresponding to the first-column pixel and the second-column pixel are the same, the first-column pixel is an even-numbered column of pixels, and the second-column pixel is an odd-numbered column of pixels;

the turn-on time C2 of a gate activating signal of the corresponding even-numbered column of pixels is greater than the turn-on time C1 of a gate activating signal of the odd-numbered column of pixels.

7. The display panel according to claim 6, wherein C2>C1, and m*C2=C1, wherein m is at least equal to 0.5 and less than 1.

8. The display panel according to claim 7, wherein the value of in is one of 0.5, 0.55, 0.6, 0.65, 0.7, 0.75, 0.8, 0.85, 0.9, and 0.95.

9. The display device according to claim 6, wherein the display device is one of a twisted nematic display device, an in-plane switching display device, and a multi-domain vertical alignment display device.

10. A driving method of a display panel, comprising the following steps:

outputting, by a gate riving chip, a gate activating signal to each row of pixels according to a preset number of times;

outputting, by a data driving chip, a same data signal to a first-column pixel and a second-column pixel of each row of pixels;

controlling each pixel group and an adjacent pixel group in each row of pixels to adopt data driving signals of opposite polarities, wherein cacti pixel group comprises an anterior first-column pixel and a posterior second-column pixel adjacent to each other, wherein the first-column pixel and the second-column pixel are connected to two different gate lines and are connected to the same data line; and controlling, by the gate driving chip, the turn-on time of a gate activating signal of the corresponding second-column pixel to be less than the turn-on time of a gate activating signal of the corresponding first-column pixel;

wherein the polarities of data driving voltages corresponding to the first-column pixel and the second-column pixel are the same, the first-column pixel is an odd-numbered column of pixel, and the second-column pixel is an even-numbered column of pixel;

the turn-on time C1 of a gate activating signal of the corresponding odd-numbered column of pixel is greater than the turn-on time C2 of a gate activating signal of the even-numbered column of pixel.

11. The driving method of a display panel according to claim 10, wherein C1>C2, and C2=m*C1, wherein in is at least equal to 0.5 and less than 1.

12. A display device, comprising a display panel, the display panel comprising:

a substrate;

the substrate is provided thereon with:

a plurality of data lines, a plurality of gate lines, and a plurality of pixels;

the pixels comprise sub-pixels of different colors respectively disposed along the direction of the gate lines;

a gate driving chip configured to output a gate activating signal to the gate lines to turn on the pixels;

each row of the pixels comprises a plurality of pixel groups; each of the plurality of pixel groups comprises an anterior first-column pixel and a posterior second-column pixel adjacent to each other; the first-column pixel and the second-column pixel are connected to the same data line;

and the first-column pixel and the second-column pixel are connected to two different gate lines;

the polarities of data driving signals adopted by each pixel group and an adjacent pixel group in each row of the pixels are opposite;

a timing control chip configured to control the turn-on time of gate activating signals of the first-column pixel and the second-column pixel;

the turn-on time of the gate activating signal of the first-column pixel is greater than the turn-on time of the gate activating signal of the corresponding second-column pixel.

* * * * *